US009752315B1

(12) United States Patent
Phillips

(10) Patent No.: US 9,752,315 B1
(45) Date of Patent: Sep. 5, 2017

(54) GUARD APPARATUS FOR A CURB INLET

(71) Applicant: Paul E. Phillips, Folcroft, PA (US)

(72) Inventor: Paul E. Phillips, Folcroft, PA (US)

( * ) Notice: Subject to any disclaimer, the term of this patent is extended or adjusted under 35 U.S.C. 154(b) by 607 days.

(21) Appl. No.: 14/301,925

(22) Filed: Jun. 11, 2014

Related U.S. Application Data

(60) Provisional application No. 61/834,083, filed on Jun. 12, 2013.

(51) Int. Cl.
*E03F 5/06* (2006.01)

(52) U.S. Cl.
CPC ..... *E03F 5/06* (2013.01); *E03F 2005/063* (2013.01)

(58) Field of Classification Search
None
See application file for complete search history.

(56) References Cited

U.S. PATENT DOCUMENTS 232,948 A * 10/1880 Dernham ..... E03F 5/0404 210/163
374,393 A * 12/1887 Campbell ..... E03F 5/046 404/25
459,259 A * 9/1891 Shunk ..... E03F 5/0404 210/163
468,714 A * 2/1892 Whitten ..... E03F 5/046 404/25
505,130 A * 9/1893 Ryan ..... E03F 5/0404 210/164
506,267 A * 10/1893 Sefton ..... E03F 1/00 210/131
642,530 A * 1/1900 Robertson ..... E03F 5/046 210/307
672,868 A * 4/1901 Banwell ..... E03F 5/046 404/4
693,511 A * 2/1902 Garrett et al. ..... E03F 5/0404 210/163
783,556 A * 2/1905 Van Buskirk ..... E03F 5/0404 210/163
1,245,903 A * 11/1917 Gross ..... E03F 1/00 210/163
1,479,651 A * 1/1924 Clements ..... E01F 9/541 362/152
1,654,246 A * 12/1927 Egan ..... E03F 5/046 210/163
1,659,364 A * 2/1928 Kelley ..... E03F 5/046 404/4

(Continued)

OTHER PUBLICATIONS

Miriam Gordon and Ruth Zamist, "Municipal Best Management Practices to controlling trash and debris in stormwater urban run-off," California Coastal Commission, 2006.

*Primary Examiner* — Robert James Popovics
(74) *Attorney, Agent, or Firm* — Robert J. Yarbrough; Lipton, Weinberger & Husick

(57) ABSTRACT

A guard for curb inlets prevents entry of large objects such as cans and bottles into the opening of the curb inlet, but allows water to enter the opening. The guard defines a relief on its bottom side so that the guard may be installed at the correct height without measurement. The guard may be composed of first and second or first, second and third slidably-engaged portions to allow the length of the guard to be user-selectable to fit a variety of curb inlets. The guard may include a grill to strain smaller debris from the water.

9 Claims, 15 Drawing Sheets

(56) References Cited

U.S. PATENT DOCUMENTS 1,711,674 A * 5/1929 Egan ..... E03F 5/046 210/163
2,473,279 A * 6/1949 Crocker ..... E03F 5/046 404/4
4,594,157 A * 6/1986 McGowan ..... E03F 5/06 210/163
4,610,566 A * 9/1986 Albang ..... E01C 19/506 249/1
5,037,542 A * 8/1991 Carroll ..... E01F 5/005 137/527.8
5,232,587 A * 8/1993 Hegemier ..... B01D 29/111 210/162
5,403,474 A * 4/1995 Emery ..... E03F 1/00 210/163
5,702,595 A * 12/1997 Mossburg, Jr. ..... E03F 1/00 210/163
6,015,489 A * 1/2000 Allen ..... E03F 5/0404 156/71
6,017,166 A * 1/2000 Mossburg, Jr. ..... E03F 1/00 210/163
6,402,942 B2 * 6/2002 Cardwell ..... E03F 1/00 210/155
6,972,088 B2 * 12/2005 Yehuda ..... E03F 1/00 210/156
6,974,540 B1 * 12/2005 Fleischmann ..... E03F 1/00 210/163
7,128,495 B1 * 10/2006 Lill ..... E01C 11/223 292/257
7,160,048 B1 * 1/2007 Fattori ..... E01C 11/227 404/2
7,179,371 B1 * 2/2007 Bistline ..... E03F 5/06 210/163
7,549,820 B1 * 6/2009 Happel ..... E03F 1/00 210/163
D597,653 S * 8/2009 Calkins ..... D23/388
7,611,304 B2 * 11/2009 Lill ..... E01C 11/223 210/163
7,699,978 B2 * 4/2010 Dyer ..... E01C 11/223 210/131
7,780,372 B2 * 8/2010 Fattori ..... E01C 11/223 404/2
7,914,229 B2 * 3/2011 Aubusson ..... E03F 5/06 210/163
7,993,072 B2 * 8/2011 Lill ..... E03F 5/0404 210/163
8,017,006 B2 * 9/2011 Lopez ..... E03F 1/00 210/163
8,051,568 B2 * 11/2011 Moody ..... E03F 1/00 210/164
8,075,220 B1 * 12/2011 Suljevic ..... E01C 11/222 404/2
8,216,453 B2 * 7/2012 Moody ..... E03F 1/00 210/163
8,235,624 B2 * 8/2012 Lill ..... E03F 5/0404 210/163
8,343,357 B2 1/2013 Horner
8,366,923 B1 * 2/2013 Happel ..... E03F 5/14 210/170.03
8,522,408 B2 * 9/2013 Lill ..... E03F 1/00 24/514
8,535,523 B2 * 9/2013 Friezner ..... E03F 5/0404 210/156
8,657,524 B2 * 2/2014 Lill ..... E03F 5/046 210/163
8,940,160 B2 * 1/2015 Lill ..... E03F 5/06 210/162
8,945,375 B2 * 2/2015 Friezner ..... E03F 5/0404 210/131
9,057,189 B2 * 6/2015 Flury ..... E03F 5/046
9,428,899 B2 * 8/2016 Friezner ..... E03F 5/0404
2005/0051467 A1 * 3/2005 Yehuda ..... E03F 1/00 210/156
2006/0285925 A1 * 12/2006 Fattori ..... E01C 11/227 405/36
2007/0086856 A1 * 4/2007 Lill ..... E01C 11/223 404/4
2008/0006568 A1 * 1/2008 Moody ..... E03F 1/00 210/164
2008/0105603 A1 * 5/2008 Hurst ..... E03F 5/0404 210/163
2009/0067922 A1 * 3/2009 Fattori ..... E01C 11/223 404/4
2009/0114579 A1 * 5/2009 Dyer ..... E01C 11/223 210/155
2010/0288684 A1 * 11/2010 Lopez ..... E03F 5/0404 210/163
2011/0100886 A1 * 5/2011 Lill ..... E03F 5/0404 210/164
2012/0103883 A1 * 5/2012 Friezner ..... F15D 1/0005 210/156
2012/0292239 A1 * 11/2012 Lill ..... E03F 5/06 210/163
2012/0294676 A1 * 11/2012 Lill ..... E03F 5/046 404/4
2013/0011192 A1 * 1/2013 Lill ..... E03F 5/046 404/4
2014/0041744 A1 * 2/2014 Friezner ..... E03F 5/0404 138/39
2014/0097133 A1 * 4/2014 Flury ..... E03F 5/046 210/170.03
2015/0053598 A1 * 2/2015 Friezner ..... E03F 5/0404 210/156

* cited by examiner

GUARD APPARATUS FOR A CURB INLET

I. STATEMENT OF RELATED APPLICATIONS

This application claim priority for U.S. provisional patent application 61/834,083 filed Jun. 12, 2013, which application is incorporated by reference as if set forth in full herein.

II. BACKGROUND OF THE INVENTION

A. Field of the Invention

The invention is a guard for a curb inlet of a storm water management system. The guard of the invention is particularly suited for retrofitting of existing curb inlets to keep floating man-made debris such as bottles and cans from being swept into the curb inlet during rainfall events. Keeping the debris out of the curb inlet keeps the debris out of the storm water management system and out of the body of surface water into which the system drains.

B. Statement of the Related Art

Drop inlets frequently are used to drain storm water runoff from streets and parking lots. A drop inlet may be a 'grate inlet,' a 'curb inlet,' or a combination grate and curb inlet. A 'grate inlet' has a horizontal opening oriented generally parallel to the surface of the street or parking lot, with the horizontal opening covered by a grate. The grate is sufficiently strong to support the weight of a vehicle on the street or parking lot. A 'curb' inlet has an opening that is oriented generally normal to the surface of the street or parking lot and that is elongated in a direction generally parallel to the surface of the street or parking lot. The opening of a curb inlet usually is defined by the face of a concrete surround, which generally coincides with the face of the curb edging the street or parking lot. Curb inlets generally do not include a grate and are unobstructed. A 'combination inlet' has both a horizontal opening covered by a grate and a curb inlet opening that coincides with the face of the curb. The curb inlet portion of the combination inlet usually is not protected by a grate and is unobstructed.

Water entering the drop inlet through either the grate inlet or the curb inlet falls into a catch basin, from which the water enters a storm water management system and is directed to a stream or other water body. Water entering a drop inlet generally is discharged without treatment.

During a rainfall event, debris on the street or parking lot may be carried to the drop inlet by the flow of storm water. For a prior art curb inlet, the debris will be swept directly into the opening of the curb inlet and hence to the storm water management system. For a combination curb and grate inlet, debris that is adequately large is strained from the flow of storm water by the grate. If the grate becomes blinded by debris, or if the flow of water is adequately large, the water and debris flow through the unobstructed curb inlet and into the storm water management system. Any floating debris, such as bottles and cans, is carried eventually to the stream, river or other surface water into which the drop inlet drains.

III. BRIEF DESCRIPTION OF THE INVENTION

The invention is a guard configured to be retrofitted to a curb inlet or to the curb inlet portion of a combination curb and grate inlet to allow water to enter the curb inlet but to prevent the entry of large floating debris, such as cans and bottles. As used in this document and in the claims, the term 'curb inlet' means a curb inlet and also means the curb inlet portion of a combination curb and grate inlet.

In a first embodiment, the guard features an elongated bar having a pre-determined length. The length of the elongated bar is selected to span the opening of the curb inlet in a direction generally parallel to the surface of the street or parking lot. The elongated bar features two end portions and a central portion. The two end portions feature installation holes penetrating the elongated bar. The installation holes are configured to each receive a fastener, such as a bolt or screw. The elongated bar has a bottom side and a top side. The central portion and the two end portions each has a width normal to the length of the elongated member. The width of the central portion is less than the width of the two end portions so that the elongated bar defines a relief along the bottom side of the central portion and does not define a relief at the top side of the central portion. The difference in the widths and the corresponding relief of the central portion on the bottom side are selected so that when the elongated bar is installed over an opening of a curb inlet, the central portion of the elongated bar will partially occlude the curb inlet opening to block the passage of large objects such as bottles and cans, but so that the relief will allow water to pass under the elongated bar to enter the opening of the curb inlet.

The guard of the first embodiment may be composed of a sheet material, such as sheet stainless steel. Alternatively, the guard may be composed of cast iron, steel, molded polymer, or any other suitable material. The guard may be configured to be resilient to that the guard may be moved out of the way to clean the drop inlet and catch basin.

To install the guard of the first embodiment, an installer will select a guard having an elongated bar of a suitable length to span the opening of the curb inlet. The installer will place the elongated bar in a position spanning the opening of the curb inlet and with the length of the elongated bar generally parallel to the surface of the street or parking lot at the location of the curb inlet. The installer will orient the width of the elongated bar in a generally vertical direction and along the face of the curb inlet. The guard is supported above the street or parking lot by the contact between the two end portions and the curb, street or parking lot. The correct installation height of the central portion of the elongated bar above the surface of the curb, street or parking lot is automatically selected by the relief between the bottom side of elongated bar at the central portion and two side portions. The installer is not required to measure or otherwise select the distance between the central portion of the elongated bar and the surface of the street or parking lot, easing the task of installation and reducing the possibility of installer error.

The relief to the central portion provides a pre-defined avenue for the passage of water from the surface of the street or parking lot and beneath the elongated bar. The installer will drill installation holes in the concrete of the surround or curb, as with a conventional hammer drill, corresponding to the installation holes in the first and second end portions. The installer then will attach the elongated bar over the curb inlet by passing fasteners through the installation holes in the two end portions and attaching the fasteners to the concrete surround or the curb using the installation holes.

As a second embodiment, the guard is composed of a sheet material, such as sheet stainless steel, that has a thickness that is small compared to its length and width. The central portion of the guard is rotated by a predetermined angle, for example by 90 degrees, with respect to the two end portions of the guard. Rotating the central portion causes the installed guard to present less of an occlusion of the curb inlet while still blocking the entry of large objects such as cans or bottles. Rotation of the central portion by 90 degrees also makes the guard stronger and less subject to bending in the direction normal to the face of the curb inlet. Rotation of the central portion by 90 degrees makes the guard weaker and easier to bend in the direction normal to the surface of the street or parking lot when the guard is installed. Installation of the second embodiment is the same as for the first embodiment.

As a third embodiment, the guard is adjustable for length. The central portion is divided into a first portion and an overlapping second portion. Each of the first and second portions includes an elongated slot and includes either the first end or the second end. Central portion fasteners penetrate the slot in the first portion and the slot in the second portion and allow the first portion to slide with respect to the second portion in the direction of the elongated dimension of the guard. The sliding engagement of the first and second portions and the fasteners allow the length of the guard to be selected by the user. The user can thus adjust the guard to be an appropriate length to span a curb inlet. Installation of the third embodiment is similar to that of the first embodiment, with the additional step of selecting the correct length for the guard by sliding the first portion with respect to the second portion.

As a fourth embodiment, the guard may support a curb inlet grill configured to fit the height and length of the curb inlet opening. When the guard featuring the curb inlet grill is installed, the curb inlet grill partially covers the curb inlet opening. Grill openings allow water to pass through the grill and strains smaller debris from the water. The size of debris strained from the water is determined by the size of the grill openings. Grill openings may be of any desired shape, such as square, round or triangular. The curb inlet grill is supported by the guard. The curb inlet grill may be composed of a thin perforated material, such as stainless steel sheet or plate. For installation, the curb inlet grill may be disposed between the first and second portions of the third embodiment and may be clamped between the first and second portions by the central portion fasteners.

In addition to sheet materials such as stainless steel, the guard may be composed of a cast material, such as cast iron, or a molded material, such as molded polymer. The molded polymer may be reinforced, as by glass fibers. The curb inlet grill may be integral with and incorporated into the guard. For example, where the guard is composed of a molded or cast material. Any of the embodiments, including the molded or cast embodiment and the embodiment with a rotated central portion, may be equipped with a grill to strain smaller debris. Any of the embodiments, including the molded or cast embodiments and the rotated central portion embodiment, may have a length that is user-adjustable, as by a sliding or telescoping engagement.

The guard may include brackets for mounting the guard to the inside surface of opening of the curb inlet so that the guard does not protrude beyond the face of the surround. Mounting the guard on the inside of the opening protects the guard from damage and prevents the bracket and the guard from being damaged by, say, the blade of a snow plow.

IV. BRIEF DESCRIPTION OF THE DRAWINGS

V. DESCRIPTION OF AN EMBODIMENT

Figure 1:
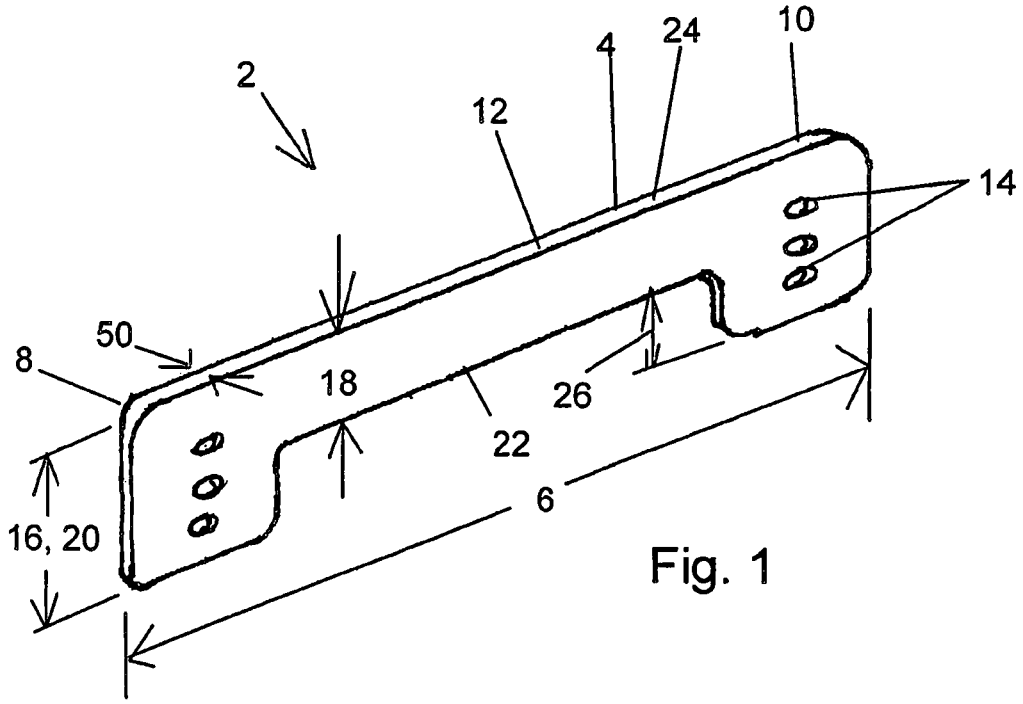
FIG. 1 is a perspective view of the first embodiment.
Figure 2:
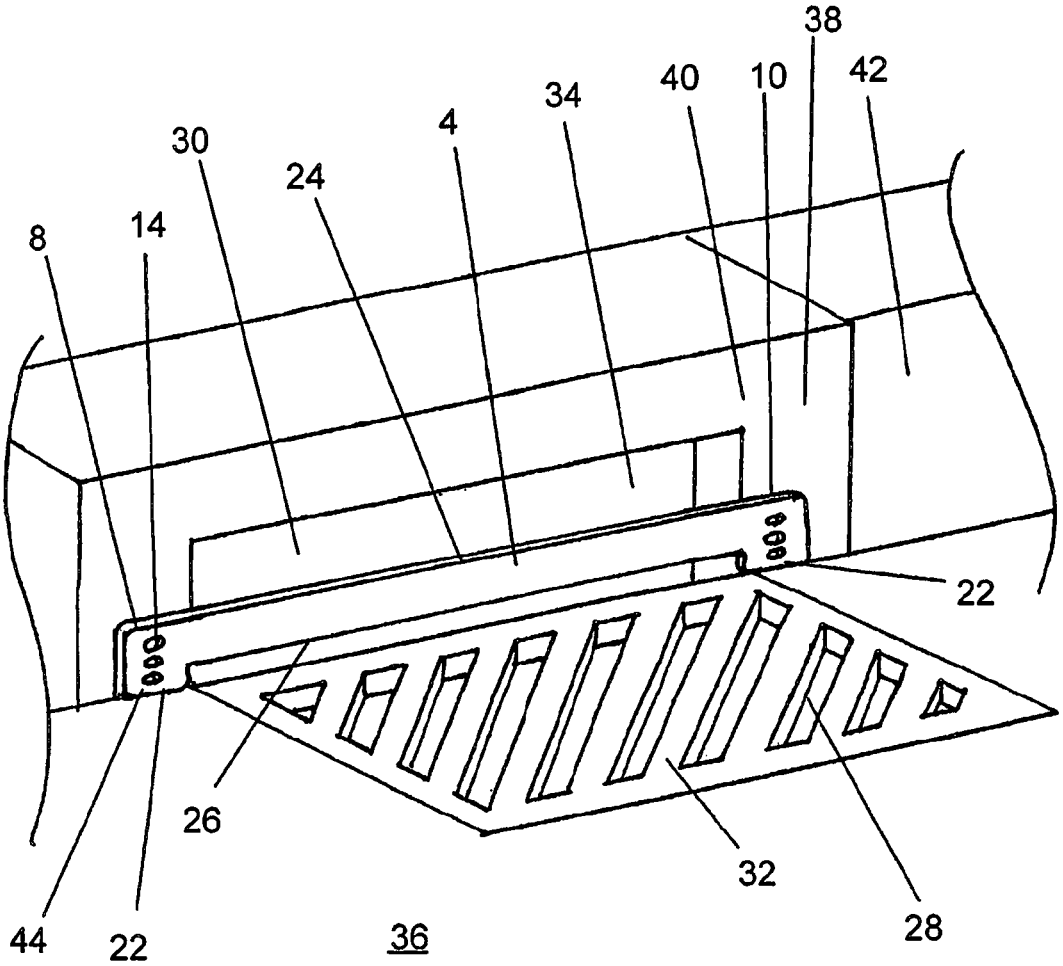
FIG. 2 is a perspective view of the first embodiment installed in a combination curb inlet and grate inlet.

FIGS. 1 and 2 illustrate a first embodiment of the guard 2 of the invention. The guard 2 is an elongated bar 4 that has a predetermined length 6. The elongated bar 4 has a first end portion 8, a second end portion 10 and a central portion 12. Installation holes 14 are defined by and penetrate first and second end portions 8, 10. The elongated bar 4 has a width 16 normal to the length 6. The width 18 of the elongated bar 4 at the central portion 12 is greater than the width 20 of the elongated bar 4 at the first and second end portions 8, 10. As a result, the central portion 12 defines a relief 26. The relief 26 is located on the bottom side 22 of the central portion 12, rather than on the top side 20 of the central portion 12.

FIG. 2 shows the guard 2 of FIG. 1 installed on a combination grate inlet 28 and curb inlet 30. The grate inlet 28 is an opening in the surface 36 of the street or parking lot. The grate inlet 28 is covered by a grate 32. Grate 32 is configured to support the weight of a motor vehicle on the surface 36 of the street or parking lot. Grate 32 generally is composed of cast iron for safety, security and cost reasons. Curb inlet 30 has an opening 34 that is elongated in a direction generally parallel to the surface 36 of the street or parking lot. The opening 34 is generally defined by the face 38 of the curb 42 or the surround 40 normal to the surface 36 of the street or parking lot. The opening 34 of the curb inlet 30 generally is defined by the face 38 of the curb 42 or of the surround 40. As shown by FIG. 2, the length 6 of the guard 2 is selected to span the opening 34 of the curb inlet 30. The surround 40 of the curb inlet 30 generally is composed of concrete. Fasteners 44 pass through the installation holes 12 and anchor the guard 2 to the concrete surround 40 or to the curb 42. When installed on the curb inlet 30, the guard 2 partially occludes the opening 34 of the curb inlet 30, preventing the entry of large objects, such as bottles and cans, into the curb inlet 30. Water can pass both over the top side 20 of the guard 2 and under the bottom side 22 of the guard 2. The relief 26 provides space for water to pass below the bottom side 22. The relief 26 also is selected to provide the correct location of the guard 2 within the curb inlet 30 when the bottom side 22 of each of the end portions 8, 10 is resting on the surface 36 of the street or parking lot or other structure immediately below the curb inlet 30 with the width 16 of the elongated bar 4 generally oriented vertically and along the face 38 of the surround 40 or curb 42. The relief 26 preferably is selected to prevent the passage of cans or bottles either above or below the guard 2 into the opening 34 of the curb inlet 30 and hence into the storm water management system.

Figure 3:
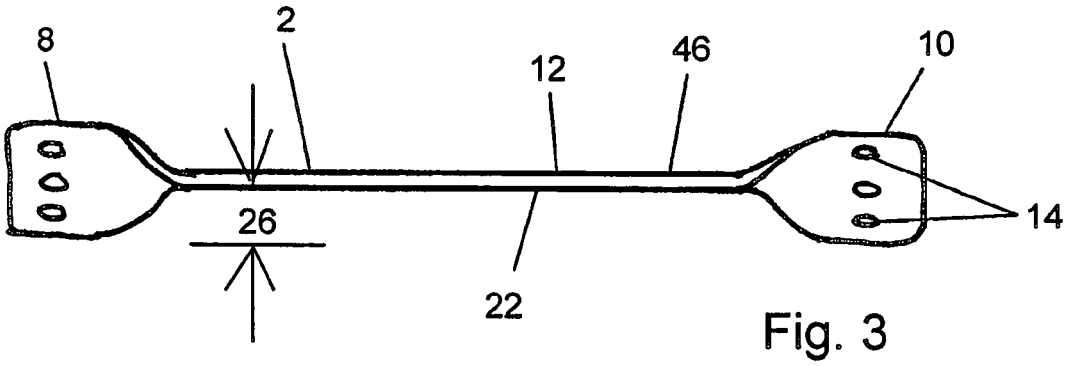
FIG. 3 is a plan view of the second embodiment
Figure 4:
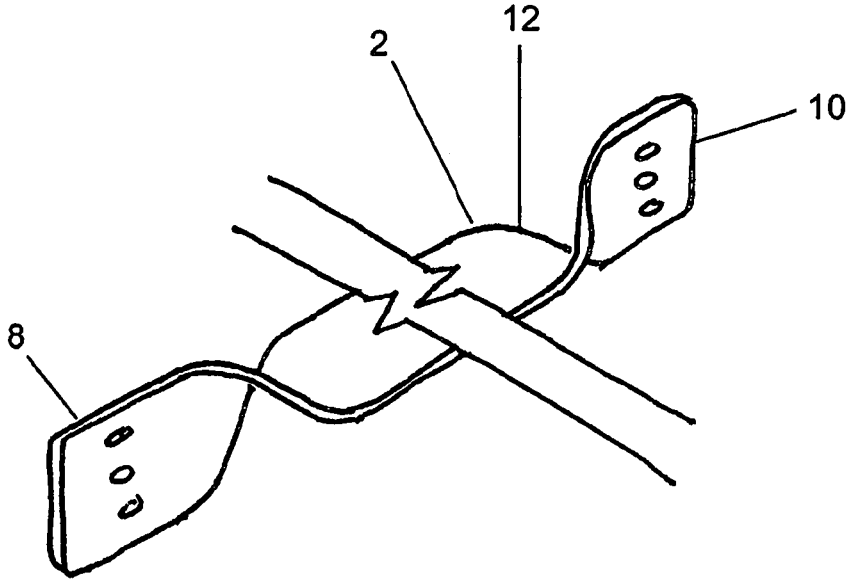
FIG. 4 is a perspective view of the second embodiment.

FIGS. 3 and 4 illustrate a second embodiment of the guard 2. FIG. 3 is a front view of the second embodiment and FIG. 4 is a detail perspective view. The guards 2 of the first and second embodiments are composed of a sheet material 46, such as stainless steel 48. The sheet material 46 has a thickness 50 that is small compared to the length 6 and the width 16 of the elongated bar 4. In the second embodiment of FIGS. 3 and 4, the guard 2 is similar to the guard of FIGS. 1 and 2, except that the central portion 12 is rotated by a predetermined angle with respect to the end portions 8, 10. Any suitable angle may be selected as the predetermined angle and 90 degrees is believed to be suitable. Rotating the central portion 12 of the guard 2 causes the central portion to define the relief 26. The guard 2 of the second embodiment is installed and operates in the same fashion as the guard 2 of the first embodiment. Rotation of the central portion 12 provides that the thickness 50 of the sheet material 46 corresponds to the width 18 of the central portion, causing the relief 26 to be greater and causing less of the surface area of the opening 34 of the curb inlet 30 to be occluded by the guard 2, which provides less obstruction to water entering the curb inlet 30. Nonetheless, the guard 2 blocks large objects such as cans and bottles from entering the curb inlet 30. Rotation of the central portion 12 also renders the guard 2 stronger in the direction normal to the face 38, reducing bending or other deformation of the guard 2 in that direction. Rotation of the central portion 12 renders the guard 2 weaker and more subject to bending or deformation in the direction parallel to the face 38 and normal to the surface 36 of the street or parking lot.

Figure 5:
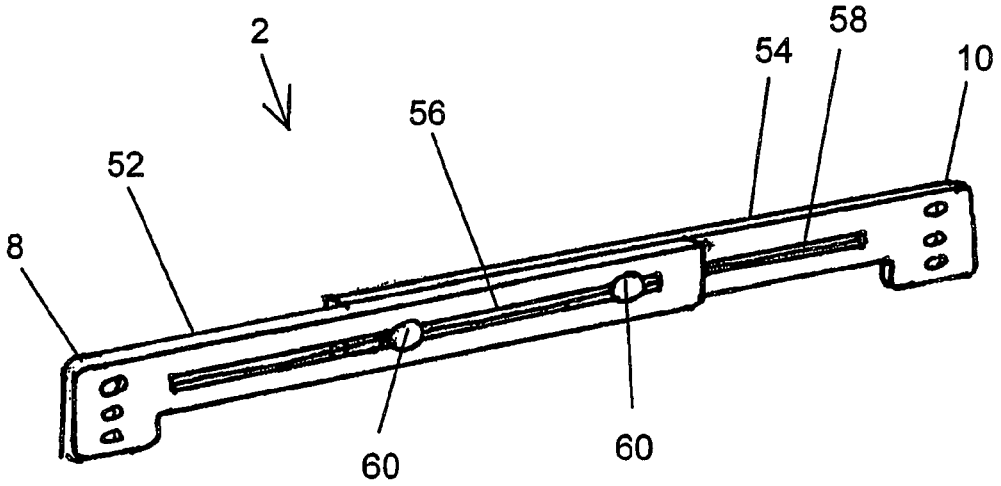
FIG. 5 is a perspective view of the third embodiment.
Figure 6:
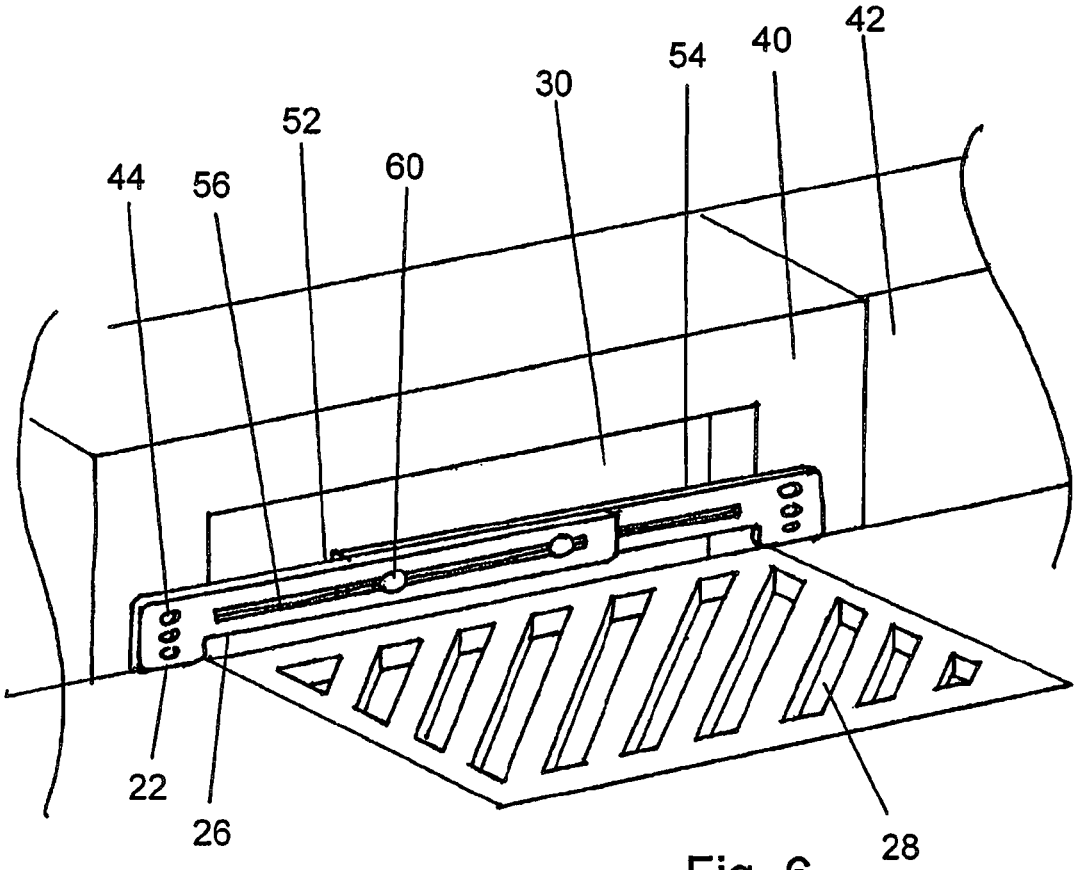
FIG. 6 is a perspective view of the third embodiment installed in a combination curb inlet and grate inlet.

FIGS. 5 and 6 illustrate an adjustable third embodiment of the guard 2 in which the central portion 12 is divided into a first portion 38 and a second portion 54, hence dividing the guard 2 into two parts. The first portion 52 defines a first slot 56 and the second portion 54 defines a corresponding second slot 58. Central portion fasteners 60 pass through the corresponding slots 56, 58, attaching the first portion 52 to the second portion 54 in a sliding engagement. The sliding engagement of the first and second portions 52, 54 allows a user to select the length 6 of the guard 2, thereby allowing a guard 2 to fit curb inlets 26 of a variety of sizes. The central portions fasteners 60 may be selected to prevent tampering with the guard 2, as by providing central portion fasteners 60 that can be turned only in the direction of tightening the fastener 60.

FIG. 6 shows the guard 2 of the third embodiment installed on a combination grate inlet 28 and curb inlet 30. The length 6 of the guard 2 is selected using the sliding engagement of the first and second central portions 52, 54 to span the curb inlet 30. The central portion fasteners 60 are engaged to fix the length 6 of the guard 2. The end portions 8, 10 are attached to the surround 40 of the curb inlet 30 by fasteners 44 passing though the installation holes 12. The guard 2 of the third embodiment otherwise functions as does the guard of the first embodiment, illustrated by FIGS. 1 and 2.

Figure 7:
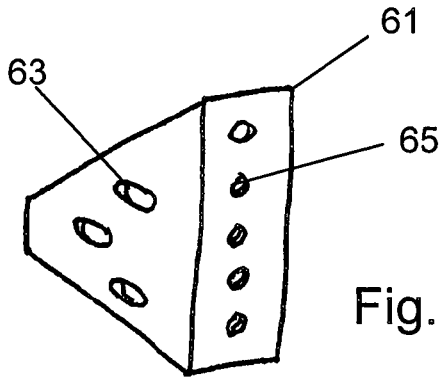
FIG. 7 is a perspective view of a mounting bracket.
Figure 8:
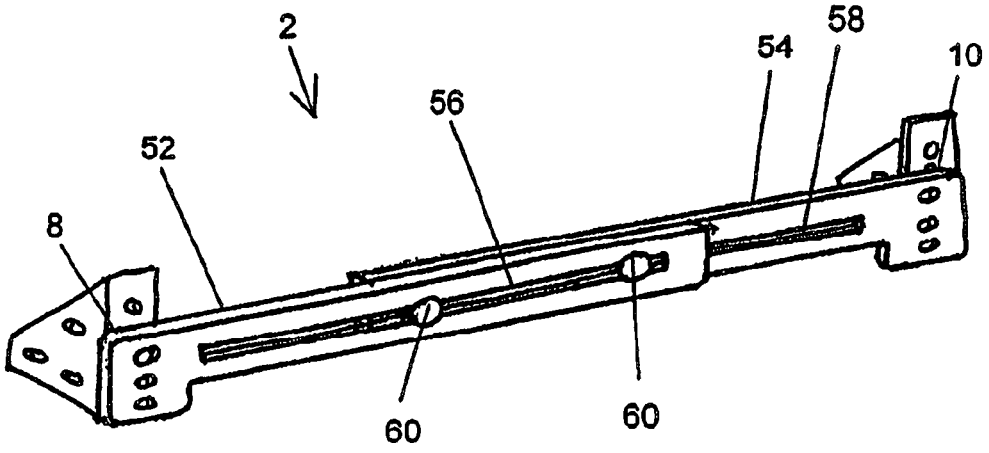
FIG. 8 is a perspective view of a guard attached to a mounting bracket.
Figure 9:
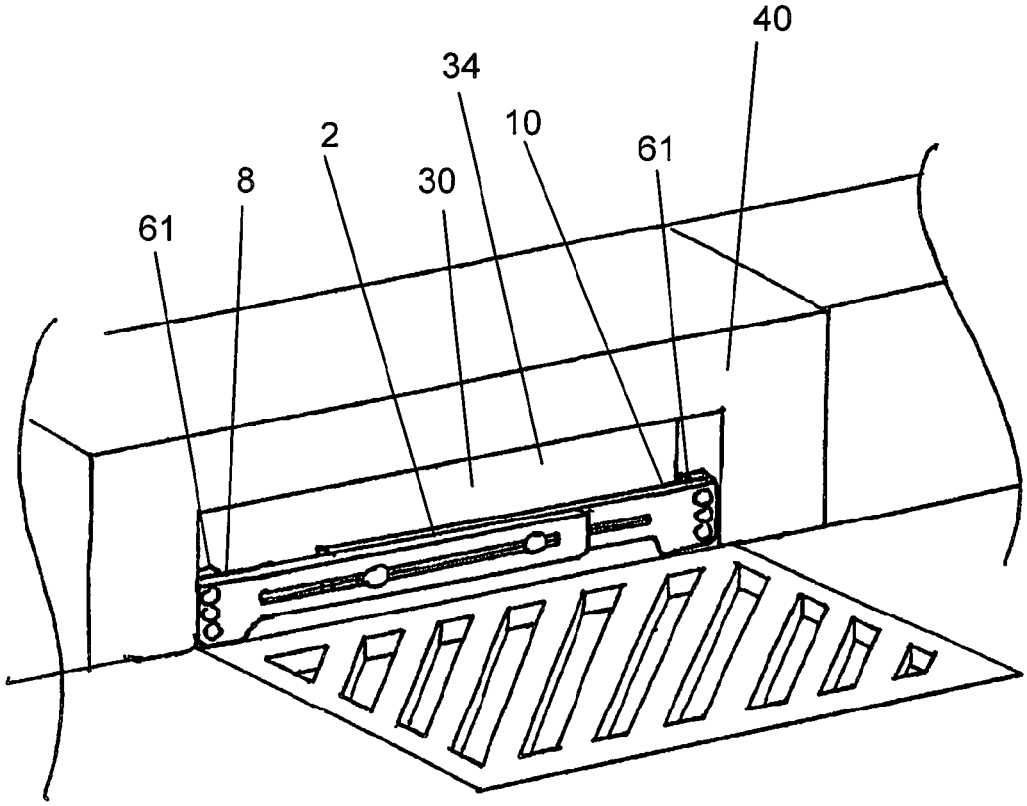
FIG. 9 is a perspective view of a guard attached to a surround using the mounting bracket.

FIGS. 7, 8 and 9 illustrates a mounting bracket 61. The mounting bracket is configured so that the mounting bracket 61 may be attached to the inside surface of the surround 40 defining the opening 34 of the curb inlet 30. From FIG. 7, three surround mounting holes 63 allow the mounting bracket 61 to be mounted to the inside surface of the surround 40. Guard mounting holes 65 allow the guard 2 to be mounted to the bracket 61 and allow the height of the guard 2 to be selected with respect to the mounting bracket 61 by selecting which of the guard mounting holes 65 through which the guard 2 will be attached.

FIG. 8 shows the guard 2 attached to two mounting brackets 61 at either end 8, 10 of the guard 2. FIG. 9 shows the guard 2 and mounting bracket 61 installed inside the opening 34 defined by the surround 40. The use of the mounting bracket 61 allows the guard 2 and the mounting hardware to be located within the opening 34 with none of the guard 2 or mounting bracket 61 protruding. The guard 2 and mounting bracket 61 are therefore protected from damage by maintenance equipment, such as snow plows.

The mounting bracket 61 may be integral to the first and second ends 8, 10 or may be separate, as illustrated by FIGS. 7-9.

Figure 10:
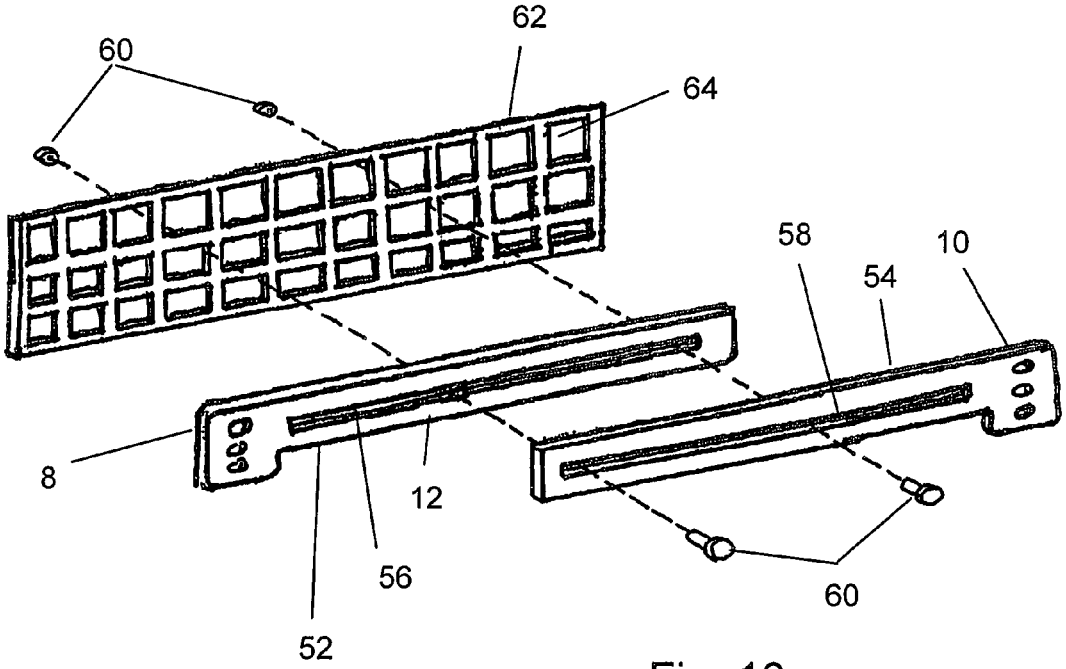
FIG. 10 is an exploded view of the fourth embodiment.
Figure 11:
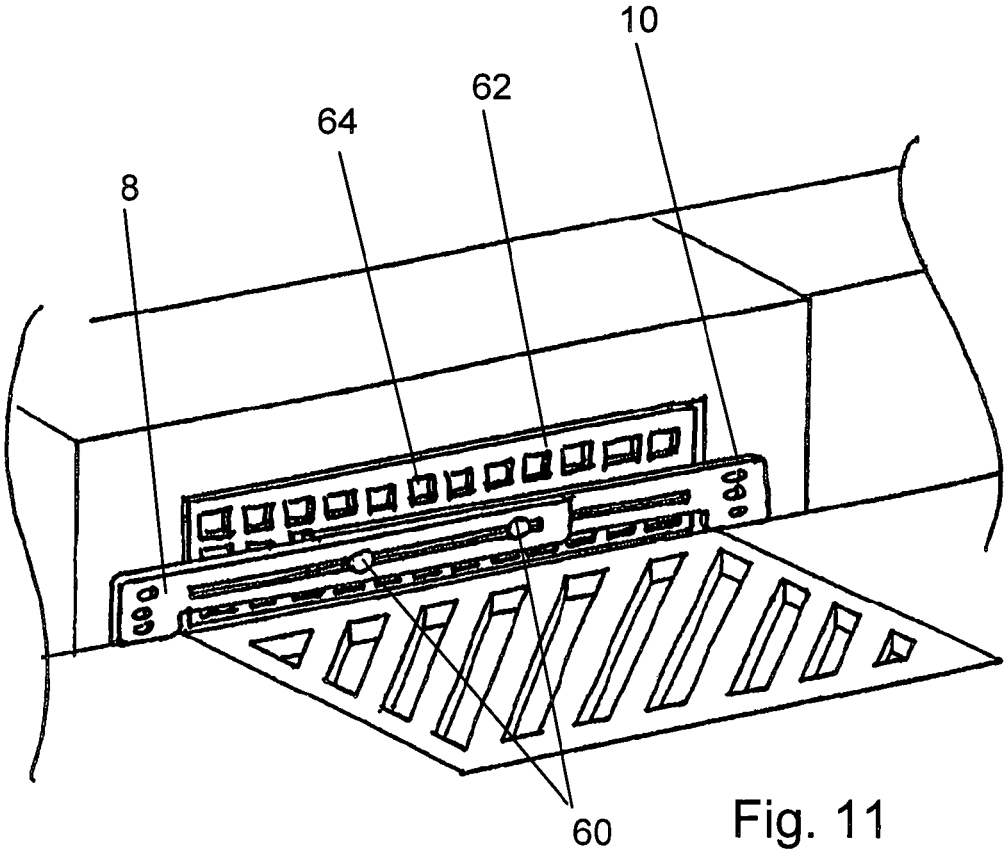
FIG. 11 is a perspective view of the fourth embodiment installed in a combination curb inlet and grate inlet.

FIGS. 10 and 11 illustrate a fourth embodiment that includes a grill 62. As shown by the exploded view of FIG. 10, the grill 62 is mounted behind between the first portion 52 and the second portion 54 of the two-part central portion 12 of the third embodiment. From FIG. 10, the grill 62 defines a plurality of grill openings 64. The central portion fasteners 60 clamp the grill 62, the first portion 52 to the second portion 54 together. A grill 62 may be incorporated into any of the embodiments of the guard 2. The grill 62 may be integral to the guard 2 or may attached to an elongated bar 4 by any technique known in the art, including fasteners, thermal welding or adhesives.

FIG. 11 shows the guard 2 including a grill 62 installed on a combination grate inlet 28 and curb inlet 30. The grill 62 is selected to substantially fill the curb inlet 30 to strain debris from storm water entering the curb inlet 30 and to keep out smaller objects. The grill openings 64 may be of any shape. FIGS. 7 and 8 illustrate rectangular grill openings 64, but any other desired shape may be selected. Any desired size for the grill openings 64 also may be selected. The guard 2 with the grill 62 otherwise is installed and operates in the same manner as the third embodiment, illustrated by FIG. 6 and the first embodiment, illustrated by FIG. 2.

Figure 12:
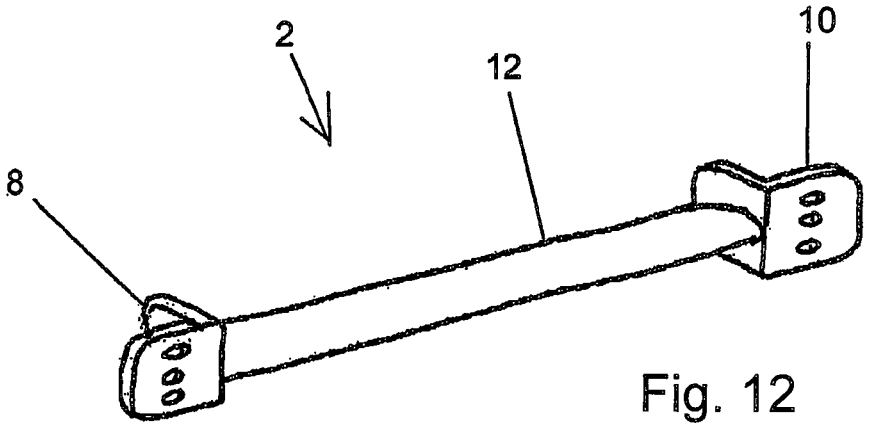
FIG. 12 is a perspective view of a guard composed of a cast or molded material, such as a cast iron or molded polymer.

FIG. 12 illustrates a guard 2 that is not composed of a sheet material 46. The guard 2 of FIG. 9 may be cast, for example cast iron 68, or molded, as a molded polymer 70. The cast or molded guard 2 is mounted to the curb inlet 30 in the same manner as the other embodiments described above and functions in the same manner to exclude large objects such as can or bottles from the curb inlet 30. The cast or molded embodiments of the guard 2 may incorporate the bracket 61 so that the guard 2 mounts directly to the inside surface of the surround 40; alternately, the cast or molded guard 2 may be attached to separate brackets 61 within the opening 34 of the curb inlet 30.

Figure 13:
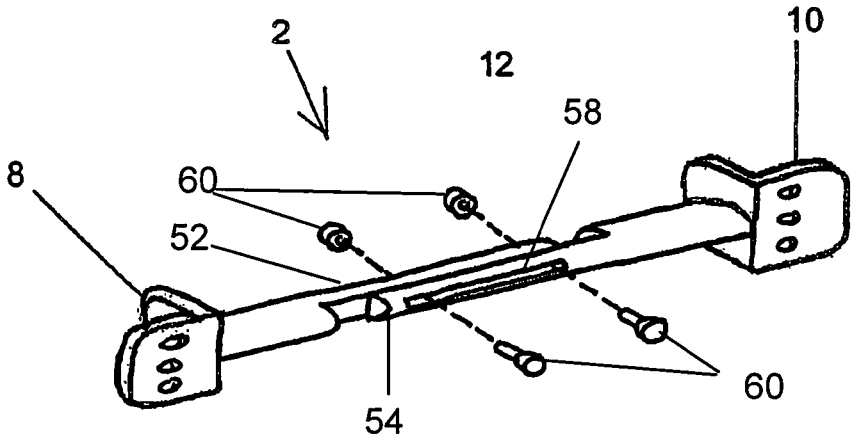
FIG. 13 is a perspective of an adjustable guard composted of cast or molded material.
Figure 14:
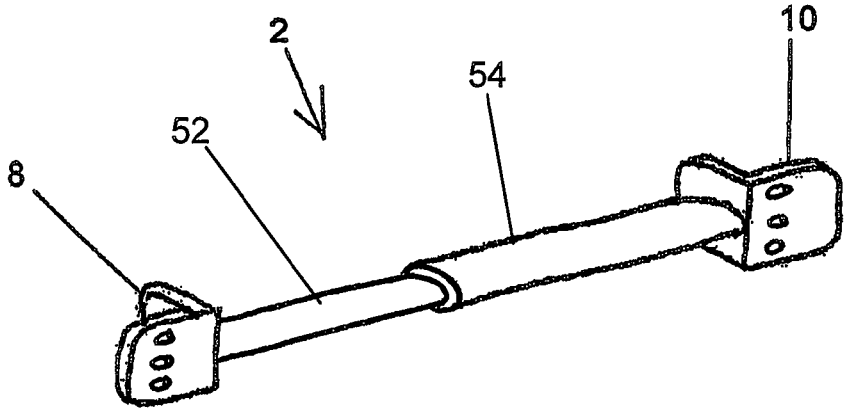
FIG. 14 is a perspective of a second adjustable guard composed of cast or molded material.

FIGS. 13 and 14 illustrate embodiments of the cast or molded guard 2 in which the guard is adjustable for length by a sliding engagement (FIG. 13) or by a telescoping engagement (FIG. 14). In FIG. 13, the first portion 52 and the second portion 54 are attached by central portion fasteners 60 passing through slots 56, 58 in the first and second portions 52, 54. In FIG. 14, the first portion 52 is in slidable engagement with an opening defined by the second portion 54 to allow a user to select the length of the guard 2.

Figure 15:
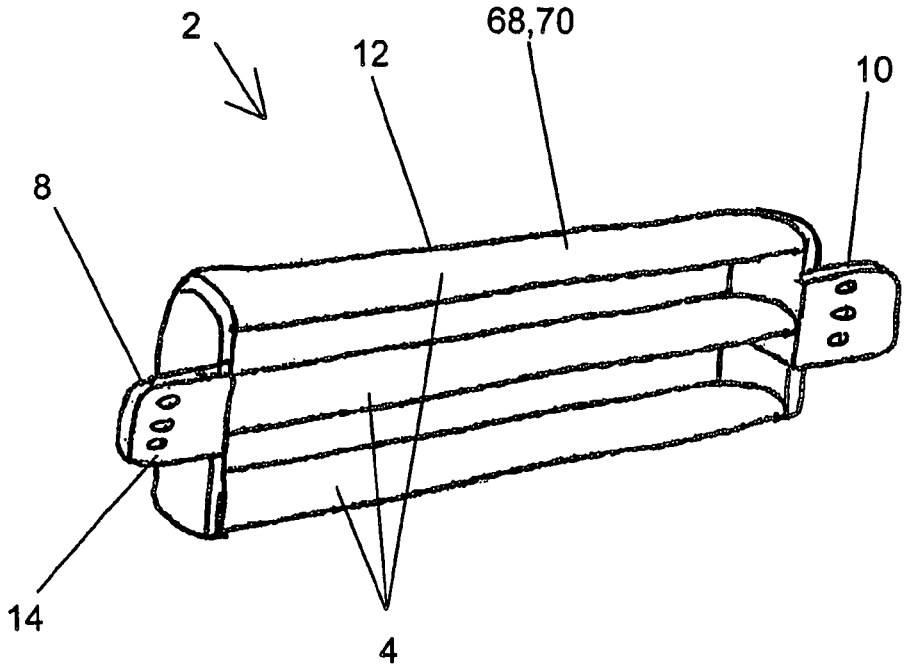
FIG. 15 is a perspective view of a guard having an integral grill composed of a cast or molded material.

FIG. 15 illustrates a guard 2 that is composed of cast or molded material, such as cast iron 68 or molded polymer 70, and in which the central portion 12 defines an integral grill 62. In the example of FIG. 10, the central portion 12 is defined by three elongated bars 4 that also define a grill 62. The three elongated bars 4 of FIG. 10 are integral to the end portions 8, 10. Any shape for the integral grill 62 may be selected, consistent with the ability to cast or mold the material from which the guard is composed, consistent with straining selected debris from the flow of water through the grill 62, and consistent with the passage of water through the grill 62.

Figure 16:
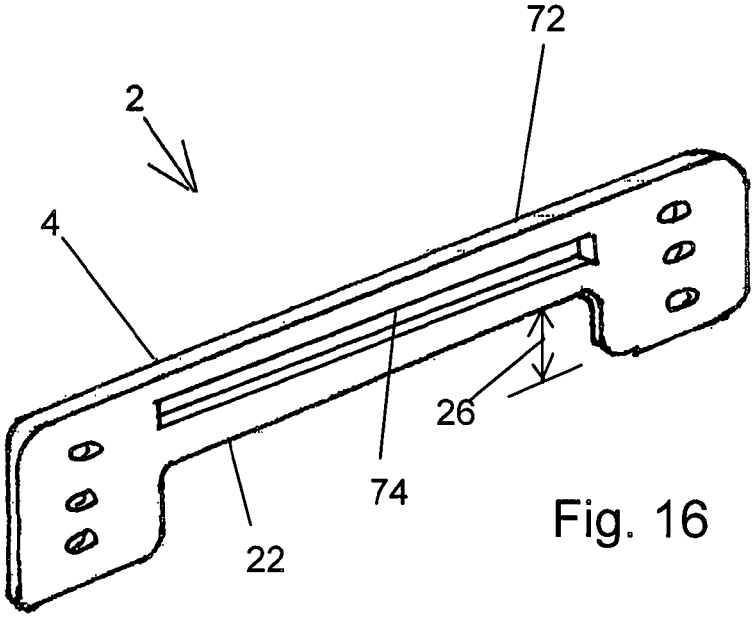
FIG. 16 is a perspective view of a third portion.
Figure 17:
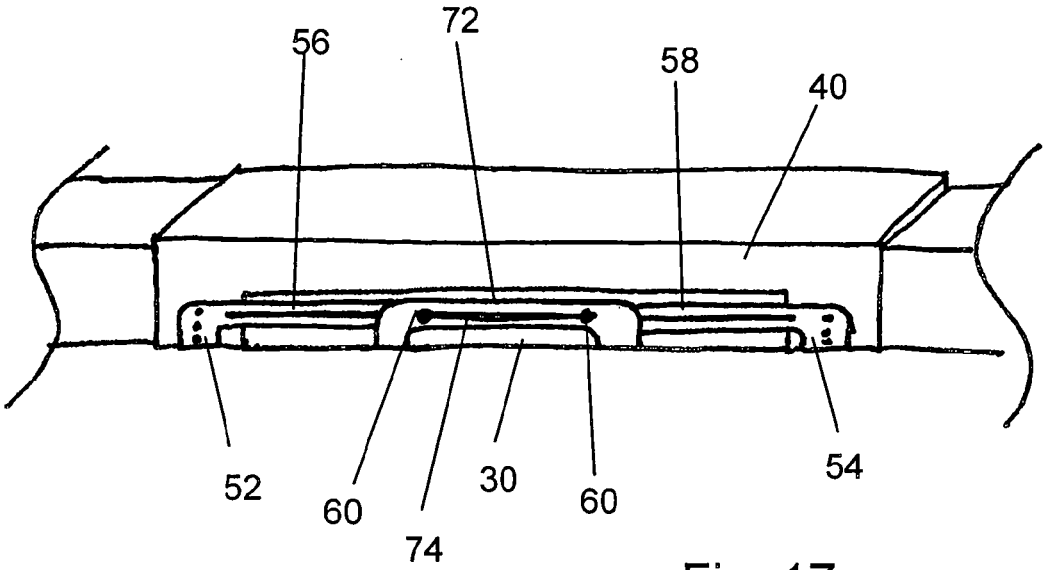
FIG. 17 is a perspective of the third portion used with a first and second portion to span a wide curb inlet.

FIGS. 16 and 17 illustrate a third portion 72 and use of the third portion 72 to span a curb inlet 30 that is too wide to be spanned by the first portion 52 and second portion 54 shown by FIGS. 5 and 6. The third portion 72 of FIGS. 16 and 17 is the same as the elongated bar 4 of FIG. 1, except that the third portion 72 of FIGS. 16 and 17 features a third portion slot 74. The third portion 72 can be attached to first portion 52 and second portion 54 by fasteners 60 extending through the third portion slot 74 and through the first slot 56 or the second slot 58. The third portion 72 defines the relief 26 so that the distance between the bottom side 22 of the third portion 72 and the surface 36 of the street or parking lot is defined to allow water to pass, but does not allow large floating objects such as bottles and cans to pass. The third portion therefore complements the self-supporting and self-calibrating nature of the elongated bar 4 of FIG. 1; namely, the third portion 72 may be installed on a curb inlet 30 without requiring the installer to measure the height of the third member 72 above the surface 36 of the street or parking lot, thus reducing the opportunity for installer error.

LIST OF NUMBERED ELEMENTS

2 a guard
4 an elongated bar
6 a length
8 a first end portion
10 a second end portion
12 a central portion
14 installation holes
16 a width of the elongated bar
18 a width of the elongated bar at the central portion
20 a width of the elongated bar the first and second end portions
22 a bottom side
24 a top side
26 a relief
28 grate inlet
30 a curb inlet
32 grate
34 an opening of the curb inlet
36 a surface of a street or parking lot
38 a face of the curb inlet
40 a surround
42 a curb
44 a fastener
46 a sheet material
48 a stainless steel
50 a thickness
52 a first portion
54 a second portion
56 a first slot
58 a second slot
60 a central portion fastener
61 mounting bracket
62 a grill
63 surround mounting holes
64 grill openings
66 guard mounting holes
66 grill slot
68 a cast iron
70 a molded polymer
82 third portion
74 third portion slot

I claim:

1. In a storm management system for a street or parking lot having a curb inlet, the improvement being a variable width guard comprising:

a pair of elongated members (52, 54), each having an elongated slot (56, 58) extending along its length, with end portions (8, 10) at one end of each elongated member (52, 54) having installation holes (14) and a downwardly extending portion such that the width of said elongated members (52, 54) is wider at said end portions (8, 10);

at least two central portion fasteners (60);

wherein said pair of elongated members are spanningly arranged across said curb inlet in overlapping fashion such that each respective elongated slot is slidably aligned with the other and said wider end portions (8, 10) are located at opposing elongated ends, with said at least two central portion fasteners (60) extending through said aligned slots and slidably connecting said elongated members to each other, while said wider end portions space a central portion (12) of said connected elongated members a distance above a surface of a street or parking lot (36) along the length of said central portion (12), defining a relief (26) through which water may pass.

2. The system of claim 1 further comprising:

a grill corresponding in shape to the opening of said curb inlet, said grill being attached to said pair of elongated members, said grill defining grill openings to strain debris from water as said water passes through said grill.

3. The system of claim 1 wherein said pair of elongated members is composed of a sheet stainless steel, a cast iron or a molded polymer.

4. The system of claim 2 wherein said grill is composed of a sheet stainless steel, a cast iron or a molded polymer.

5. A method of retrofitting a curb inlet of a street or parking lot to prevent debris from entering an opening of the curb inlet, the method comprising the steps of:

a. providing a variable width guard, said variable width guard comprising a pair of elongated members (52, 54), each having an elongated slot (56, 58) extending along its length, with end portions (8, 10) at one end of each elongated member (52, 54) having installation holes (14) and a downwardly extending end portion (8, 10) such that the width of said elongated members (52, 54) is wider at said end portions (8, 10), said variable width guard further comprising at least two central portion fasteners (60);

b. arranging said pair of elongated members (52, 54) to span said curb inlet in an overlapping fashion such that each respective elongated slot is slideably aligned with the other and said wider end portions are located at opposing elongated ends, with said at least two central portion fasteners extending through said aligned slots and slideably connecting said elongated members to each other; and c. attaching said variable width guard to the curb inlet or a curb by installing fasteners (44) through said installation holes into said curb inlet or into a curb, whereby said wider end portions (8, 10) space a central portion (12) of said connected elongated members (52, 54) a distance above a surface of a street or parking (36) lot along the length of said central portion, defining a relief (26) through which water may pass.

6. The method of claim 5, the method further comprising: selecting a width of said variable width guard to conform to the opening of the curb inlet by slidably engaging said elongated members (52, 54) prior to said step of attaching said variable width guard to the curb inlet or said curb.

7. The method of claim 6, the method further comprising: providing a grill, said grill corresponding in shape to the opening of the curb inlet, said grill being attached to said first portion and said second portion, said grill defining opening to strain debris from said water when said water passes through said grill.

8. The method of claim 6 wherein said pair of elongated members is composed of a sheet stainless steel, a cast iron or a molded polymer.

9. The method of claim 7 wherein said grill is composed of a sheet stainless steel, a cast iron or a molded polymer.

* * * * *